US010913514B2

(12) United States Patent
Martin

(10) Patent No.: US 10,913,514 B2
(45) Date of Patent: Feb. 9, 2021

(54) DEPLOYABLE BOAT HOOK

(71) Applicant: Roy W Martin, Anacortes, WA (US)

(72) Inventor: Roy W Martin, Anacortes, WA (US)

(73) Assignee: Roy W. Martin, Anacortes, WA (US)

( * ) Notice: Subject to any disclaimer, the term of this patent is extended or adjusted under 35 U.S.C. 154(b) by 0 days.

(21) Appl. No.: 16/388,383

(22) Filed: Apr. 18, 2019

(65) Prior Publication Data

US 2020/0331565 A1 Oct. 22, 2020

(51) Int. Cl.
*B63B 21/54* (2006.01)
*B63B 21/00* (2006.01)

(52) U.S. Cl.
CPC ..... *B63B 21/54* (2013.01); *B63B 21/00* (2013.01)

(58) Field of Classification Search
CPC ..... B63B 21/00; B63B 21/54; B63B 21/58; B63B 9/00; B25J 1/00; B25J 1/04
USPC ..... 114/221 R, 230.25, 230.26, 230.3; 294/104, 175, 209, 210
See application file for complete search history.

(56) References Cited

U.S. PATENT DOCUMENTS 1,536,701 A * 5/1925 Buckingham ..... B63B 21/58 114/230.25
D248,012 S 5/1978 Rensen
D253,277 S 10/1979 Hernsjo
4,261,280 A 4/1981 Collic, Sr.
4,557,214 A 12/1985 Molitor
4,595,223 A * 6/1986 Hawie ..... B25J 1/04 294/175
4,667,617 A 5/1987 Molitor
4,785,509 A 11/1988 Fisher
4,793,646 A * 12/1988 Michaud, Jr. ..... B63B 21/54 114/221 R
4,932,700 A * 6/1990 Hart ..... B25J 1/04 114/221 R
4,986,207 A * 1/1991 Reed ..... B63B 21/54 114/221 R
D338,602 S 8/1993 Schaumburg
5,381,749 A * 1/1995 Larson ..... B63B 21/54 114/221 R
5,558,377 A * 9/1996 Blum ..... B25J 1/00 294/210
5,967,575 A * 10/1999 Blake ..... B63B 21/54 114/221 R
6,027,154 A * 2/2000 Costa ..... B66C 1/36 294/209
6,739,275 B2 5/2004 Darling et al.
6,865,998 B2 3/2005 Darling et al.
D509,785 S 5/2005 Beermann et al.
6,978,730 B1 * 12/2005 McCarthy ..... B63B 21/54 114/221 R (Continued)

*Primary Examiner* — Lars A Olson
(74) *Attorney, Agent, or Firm* — Clark A. Puntigam; Jensen & Puntigam P.S.

(57) ABSTRACT

The deployable boat hook assembly includes a clamping assembly which is attachable to a pole. The clamping assembly includes a clamp adapted to temporarily secure a boat hook which is configured to connect to a receiving member on a dock. The boat hook is configured to receive a boat line extending from the boat. The temporary securement of the boat hook by the clamping assembly is overcome by an operator moving the pole in a manner to release the clamping assembly from the pole, such that the boat remains connected to the dock by the boat hook and the boat line.

17 Claims, 14 Drawing Sheets

(56) References Cited

U.S. PATENT DOCUMENTS

| | | | | |
|---|---|---|---|---|
| 8,544,919 | B2 * | 10/2013 | Oh | B25J 1/04 294/209 |
| 9,573,663 | B2 | 2/2017 | Constant, Jr. et al. | |
| 2003/0192464 | A1 | 10/2003 | Sugiyama | |
| 2013/0334396 | A1 | 12/2013 | Gifford | |
| 2014/0305362 | A1 | 10/2014 | Padick | |
| 2015/0259041 | A1 | 9/2015 | Swan | |
| 2017/0283009 | A1 | 10/2017 | Harrod | |

* cited by examiner

DEPLOYABLE BOAT HOOK

TECHNICAL FIELD

This invention relates generally to boat hooks for securing a boat to a dock element such as a cleat or other member and more specifically concerns a boat hook assembly which provides a safer and more reliable connection to a dock element.

BACKGROUND OF THE INVENTION

A foremost challenge in the presence of wind and/or current is securing a boat to a dock. The difficulty is positioning the boat adjacent to the dock long enough to allow someone to step from the boat to the dock to secure the boat lines (ropes) to the dock. The wind or motion of the current may be opposing the proper placement and holding of the boat. This situation is further aggravated in some boats by the arrangement of the controls not providing the operator a clear view of the side of the boat with respect to the dock.

An onboard docking assistant can help by providing proper information as to where the boat is with respect to the dock and standing by to step onto the dock. The proper execution of maneuvers by a trained and calm operator and trained assistant(s) will usually insure a smooth and safe docking. However, many recreational boaters often have little training and skills. The same is true for boat assistants. Many times, it is a boat operator and assistant, with the assistant lacking in expertise or dexterity. Furthermore, many recreational boaters are senior in age and thus may be not as agile as when younger. Communication under stressful conditions, for example at the end of the day and/or with stormy conditions, also may be non-ideal.

A distance may remain between the boat and the dock and/or this distance may be rapidly changing. The assistant may attempt to throw or loop a rope to a cleat on the dock. If another person is on the dock, they can catch the rope and wrap the rope around the securing system on the dock. However, often there is no one on the dock to help. This is often the case in a home port as the marina typically does not provide such a person. Further, when the boat cannot be placed immediately adjacent to the dock, the operator or the assistant may attempt to jump to the dock when the boat appears close enough. Jumping to a dock can lead to a major mishap.

A traditional boat hook is a device commonly present in most boats to aid in pushing a boat away from some obstacle or in some cases hooking some item. This device usually has a telescoping pole for changing its length and on one end (the head) a flattened portion or a place for a rubber of plastic bumper region for pushing an object without scratching it, for example another boat.

U.S. Pat. No. D 338,602 (1993) illustrates the typical head of a boat hook. Two problems are present when trying to utilize a boat hook to grasp a dock mooring device and pulling the boat to it. One is the hook may not fit the dock device, its angle may be wrong with respect to engaging it, and when trying to pull a boat to a dock with it, the telescoping section may slip open. Further, pulling on a solid pole has limited leverage, and it may be slippery in wet conditions. The hooking shape on these devices do not easily engage a dock boat attachment assembly and remain engaged. If tightly engaged the forces on the boat may overcome the ability of the assistant to hold the boat and the pole is pulled from their hands and remain attached to the dock with the handle falling in the water.

In contrast, a rope or line wrapped around a cleat on the boat, gives the user much more leverage to pull or hold a boat if the other end is attached to the dock. Another approach is to pull on a rope extending from the cleat on the boat with one hand while tightening the rope by wrapping the cleat with the other hand, i.e. puling and taking up the slack.

U.S. Pat. No. 4,261,280 describes attaching a line to a boat hook in a loop. U.S. Pat. Nos. 4,557,214 and 4,667,617 involve adding an attachment to a boat hook to hold a rope loop open during maneuvering it in order to place it, and then a means to release the boat hook from the rope allowing the rope to fall over the mooring device such as a piling or other item. U.S. Pat. No. 6,739,275 B2 is an improvement in how to wedge a rope to the boat hook to hold it during maneuvering of the boat. U.S. Pat. No. 6,865,998 B2 is an improved device for holding the rope including in one case a spring clip. U.S. design Pat. D509,785 S shows a clip and rope holder. A problem with all rope looping methods is the difficulty in connecting the rope or line with the dock member. Considerable dexterity is often necessary for success.

Other patents describe various elements aiding in docking. U.S. design Pat. D248,012 illustrates a solid hook with a handle and a rope attached to the end of the handle with a perpendicular rod attached to the solid hook. U.S. design Pat. D253,277 shows a particular configuration. U.S. Pat. No. 9,573,663 B2 describes a hook on one end with a handle and means for attaching a rope to the handle.

U.S. Pat. No. 4,785,509 describes a hook with a rope attached which can be thrown from a boat onto the dock and when pulled back will hook onto a railing. If successful, will allow the boat to be pulled to the dock.

None of the above patents, however, teach a system which effectively addresses the particular docking issues and concerns described above.

Publication Application Nos. US 2013/0277790, US 2003/0192464, US 2015/0259041, US 2013/0334396, US 2017/0283009, US 2014/0305362 all provide some means of anchoring a boat but are not relevant to mooring a boat to a dock or buoy.

SUMMARY OF THE INVENTION

This portion will be completed when the application is prepared in final form.

BEST MODE FOR CARRYING OUT THE INVENTION

Figure 1A:
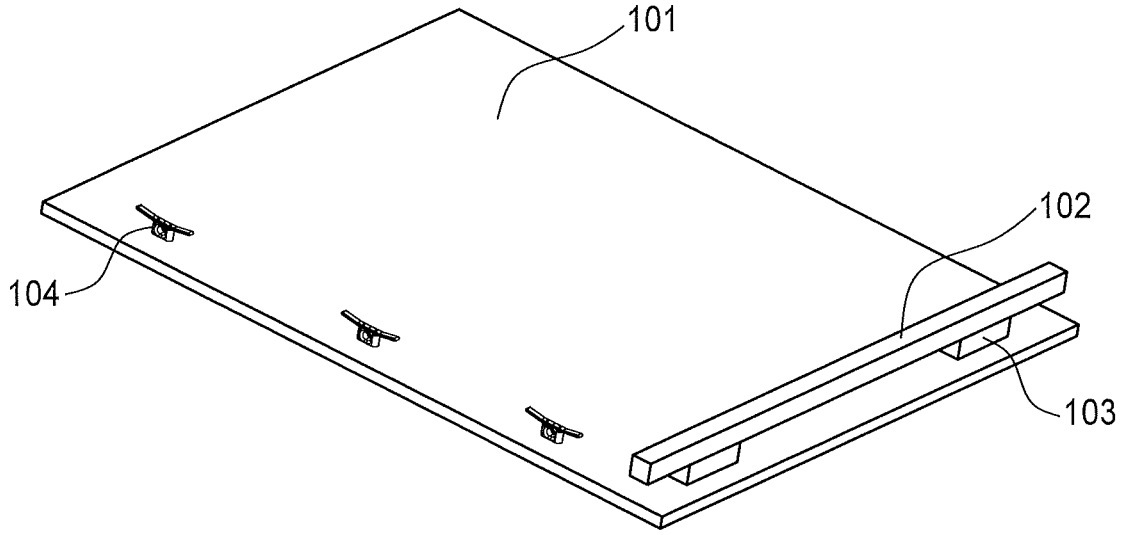
FIG. 1A is a schematic view of a dock with boat securing elements.

Disclosed herein are several embodiments for securing a boat to a dock, even when the boat is a short distance away. In general, one arrangement includes the use of an attachable/detachable clamping mechanism mounted on a pole, the mechanism including various ways to secure a boat hook thereto. The operator reaches out from the boat with the pole and places the hook through the cleat on the dock and then retracts the pole, detaching it from the clamp assembly, leaving the line hooked to the dock cleat thus securing the boat. For docks without cleats but with timber railings for tethering such as a 4"×4" horizontal plank, a larger size hook is used that will fully engage the railing to secure the boat in the same manner as mentioned above. The appropriate size hook can be chosen as the boat nears the dock and the type of tethering method needed is observed. In some designs the hooking device can have a swivel arrangement to change the angle of the hook relative to the axis of the pole used or to clamp the hook at a desirable angle with respect to the axis of the pole. This allows for easy engagement of the hook to the dock cleat, even if the user is at an elevated angle to the dock cleat and the boat is either close to the dock or if the boat is far from the dock.

The embodiments disclosed herein have three important features: the first feature allows readily changing the distance from the boat to the docking device using a telescoping pole; the second feature allows in most embodiments simple methods for changing the angle of the hook with respect to the axis of the pole, allowing accommodating various attack angles of the pole with respect to the dock surface and the dock attachment device; and the third feature allows using different style of hooks for mating with different type of mooring devices, for example, a rectangular rail or cleat.

Generally there are two types of embodiments disclosed herein for attaching a pole to a hook: In the first type of embodiment, a clamp, mechanical or magnetic, is designed to be rigidly attached to a pole and the clamping mechanism is designed to clamp to any hook. The advantage of this embodiment is only one clamp is needed and it can be used with different style hooks; further, the hooks can be a simple and economical design. Thus, several hooks with configurations to match a variety of dock attachment mechanisms (for example cleats or wood railings) can be maintained in the boat, and the appropriate one selected as the situation indicates. A threaded pole can be used, which offers a practical device for a quick connect and disconnect of which there are many commercial examples. Another embodiment has a spring clamp attached to each hook which clamps to the pole used. The clamp is designed to latch to various poles including the style commonly found on boats. This embodiment has the advantage of not requiring any special pole to be used; however, it has the disadvantage that each hook must have its own clamp. The various means of achieving the clamping action in each of these embodiments is provided in the following detailed description.

FIG. 1A illustrates the major components of a marine dock. A marine dock is typically composed of a floating platform with a dock surface 101 and boat securing assemblies, such as a horizontal railing 102 supported off the dock by spacers 103, or alternatively a series of cleats 104. The horizontal railing 102 is typically 4"×4" timber and the spacers are often of similar but shorter pieces of the same material. A 2"×4" can also be used for the spacers. The spacers and railing are secured to the dock with bolts to ensure an assembly that will withstand the force of boats pulling on it even in high wind storms.

Figure 1B:
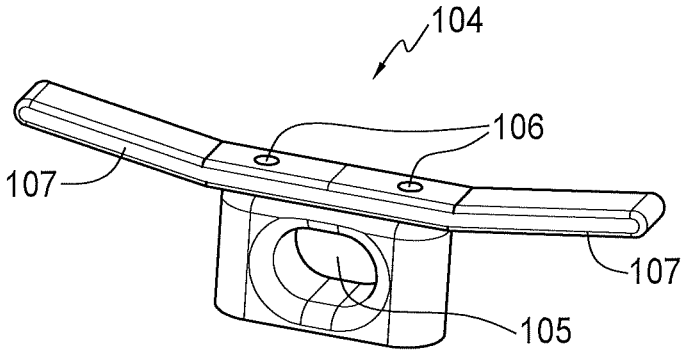
FIG. 1B is a schematic view of a boat securing cleat on a dock.

FIG. 1B illustrates a typical cleat 104 showing an opening or eyelet 105 for a rope or ropes or line to be passed through. This opening 105 is the main objective to pass a hook into as described hereafter. The cleat has two ears 107 for wrapping a rope or boat line, as often used in marine nomenclature, for securing a boat. The holes 106 allow bolts to be passed through for connecting the cleat to the dock.

FIGS. 2-11 illustrate several embodiments a first type of dock hook assembly in which a pole is connected to a clamping device to clamp and hold a hook with a rope attached to it for remotely placing a hook onto a dock boat securing assembly. The clamp is disengaged from the hook once the hook has properly hooked or captured the boat securing assembly on the dock, by pulling back on the pole. The rope on the hook is then pulled by a user on the boat to pull the boat close enough to the dock to allow a user to step to the dock for the final securing action. Once on the dock the user can remove the rope from the hook and attach it directly to the dock boat securing assembly in the usual manner. The hook can then be stored back on the boat.

FIGS. 12-13 illustrate an embodiment of a second type of the dock hook assembly in which a clamping device is mounted to a boat hook with a rope attached. The hook is engaged with the dock boat securing assembly. Once the hook has engaged the dock boat securing assembly, a reverse tug on the pole will pull it loose from the hook and clamp, leaving it hooked to the dock with a rope attached. A user can then proceed to secure the boat in the same manner as described for the first type.

FIG. 14 illustrates a device which can be attached to a boat hook to ensure that the line remains attached to the hook during the action to place the hook on the boat securing assembly on the dock.

Figure 2:
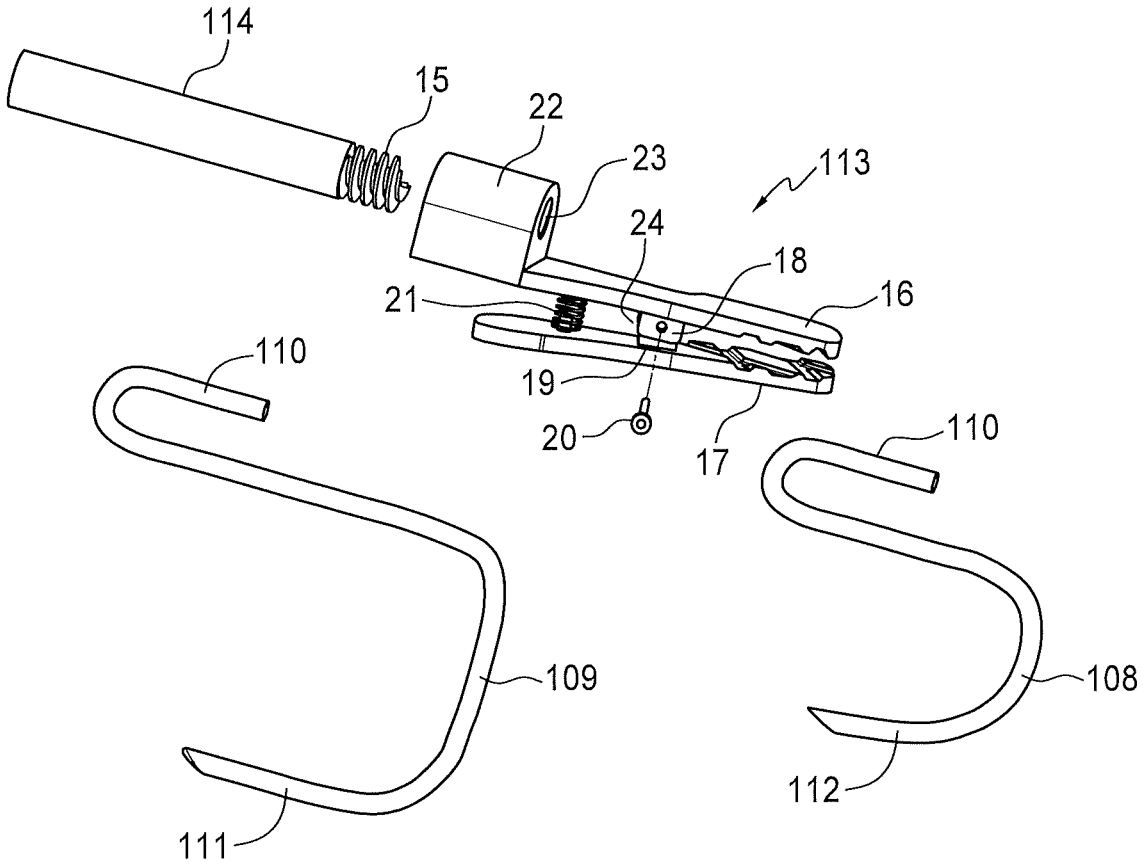
FIG. 2 is a exploded view of one type of a first embodiment of the boat hook assembly of the present invention.

Referring now in detail to the Figures, FIG. 2 includes a pole 114 and an attachable clamp 113. Two types of boat hooks are shown: a hook 108 suitable for a cleat 104 and a hook 109 suitable for a 4"×4" railing 102. The pole 114 has a thread 15 with a preferred ¾"-5 right hand thread. This particular thread is commonly employed in telescoping poles for painting and window washing. It also is used with removable brushes and brooms. Other threads can be used. The internal threads 23 in a housing 22 mounted on an upper part 16 of the clamp will receive threads 15 for attaching the clamp to the pole. A projection 18 from upper part 16 provides one half of a pivot hinge 24. The other half of the pivot hinge is provided by a projection 19 from a bottom part 17 of the clamp. The hinge includes a pin 20 for rotation, shown removed for illustration. Small projections (not shown) on the underside of 16 and the upper side of 17 hold a spring 21 in position to force the clamp parts 16 and 17 against each other about the hinge 24. Grooves 22 in the mating sides of parts 16 and 17 hold a hook in one of two positions illustrated, in FIGS. 3A and 3B. Alternative designed hinge clamps may be used with a different spring arrangement, such as is used in a clothes pin.

The hook 108 for a cleat has a length and curvature 112 for fully engaging the hole 105 of a cleat 104 and allow securely encompassing the body of the cleat from the upper side of the hole. The hook also has a curvature and length 110 to slip a rope or line 25 through for connecting to the hook as shown in FIG. 3. The region 110 could be closed forming an eyelet for holding a rope. The disadvantage of an eyelet is the rope must be threaded through it then secured in some type of knot. This is less versatile than the design shown in FIG. 2. Most dock lines have one end formed in a braided loop. Such a loop is simply slipped on to the open design of 110 and also easily slipped off once docked. An alternate but similar hook 109 is shown for hooking a 4"×4" railing. This hook has a length and curvature 111 to accommodate the size and shape of a railing. Hook 109 also has a length and curvature 110 for connecting a line 25 to it. The hooks are made from iron or steel rod formed in the desired shape and length. The diameter of the pole may vary, but 5/16 is a preferred size.

Figure 3A:
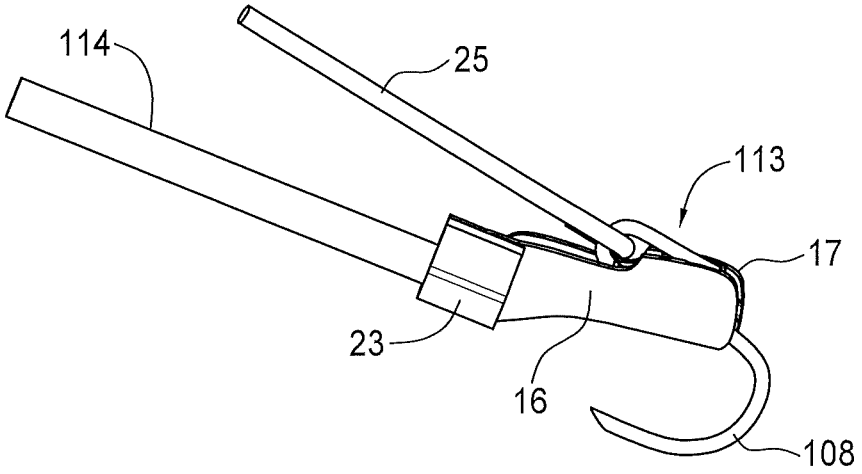
FIG. 3A is a perspective view of the boat hook assembly of FIG. 2 in a first position.

FIG. 3A illustrates hook 108 being grasped and held by clamp 113 connected to a pole 114 through threads 15 on the pole and the threads 23 of the clamp, in one position for engaging a cleat 104 when the operator is located on the boat at some distance from the cleat. Pole 114 generally in this situation would be at an angle of approximately 30° to the horizontal dock and the hook 108 is clamped at an angle with respect to the pole 114 for ease in capturing the hole or eyelet 105 of the cleat 104 in this situation. A rope or line 25 is shown passed through the region 110 of the hook for securing the hook to the boat. Once the hook is properly placed on the cleat the operator pulls the pole 114 back and the clamp 16 will snap off of the hook leaving it engaged with the cleat, allowing the line 25 to be tightened to pull the boat to the dock.

Figure 3B:
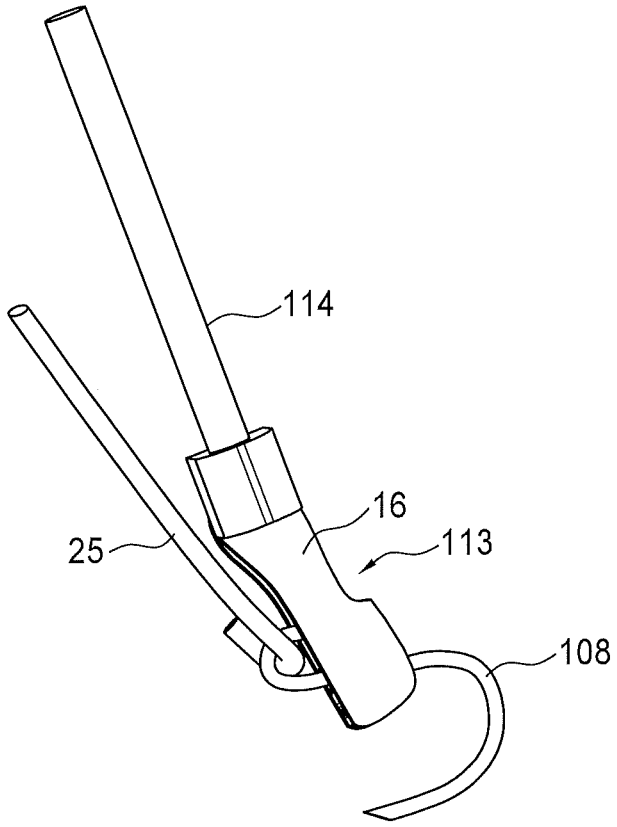
FIG. 3B is a perspective view of the boat hook assembly of FIG. 2 in a second position.

FIG. 3B illustrates the position of the pole 114 and clamp 113 when the boat is fairly close to the dock and the operator is in an elevated position with respect to the level of the dock. The hook 108 has been grasped by the clamp 113 at an angle of approximately 120° with respect to the axis of the pole 114 to allow for easy engagement of the hole 105 of a cleat 104. Once the cleat has been hooked, the pole 114 with the clamp 113 is pulled up, which will disengage the clamp 113 from the hook 108. The boat is then pulled to the dock in the same way as described in FIG. 3A.

The grooves 22 in the clamp of FIG. 2 are placed at angles to help the hook 108 or 109 being held in the positions shown in FIG. 3A or 3B. The grooves aid in holding the hook as the pole, clamp, hook with rope are being maneuvered into position. Instead of grooves the inside surface of the clamp parts 16 and 17 may be coated with a rubber material or nonslip material to aid in holding the hook in the clamp.

A possible shortcoming of this type of clamp is the parts 16 and 17 pivot around the hinge point 18 and 19 in a way such that when the tip of the parts 16 and 17 come together, touching each other or the surface of a hook, the more proximal areas (i.e. closer to the hinge point) will not mate as closely to each other or the hook as the more distal areas. This may cause the hook to be grasped less firmly than if the whole inside surface of the parts would equally contact the hook. The thickness of fingers 16 and 17 may be tapered in diminishing thickness towards the distal end to overcome this disadvantage, allowing for a more uniform mating along the parts as they close.

Figure 4A:
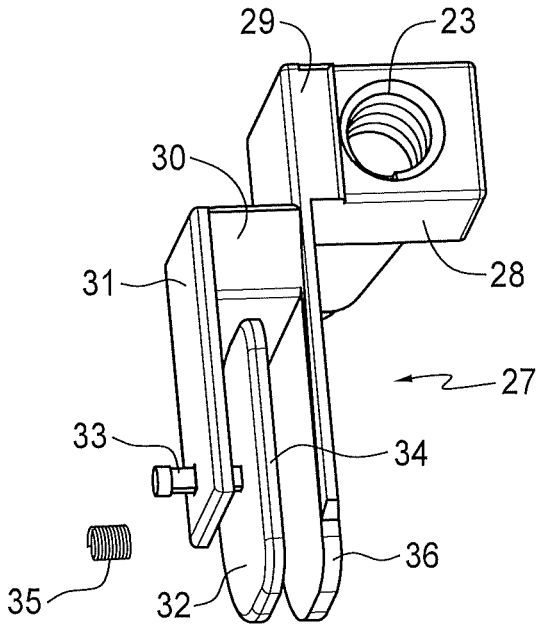
FIG. 4A is a perspective view without a boat hook of a first variation of the first type of boat hook assembly.

FIG. 4A illustrates an alternate clamp embodiment 27 which differs from the hinge clamp embodiment. The purpose of this embodiment is to apply more uniform pressure on a hook by the clamping surfaces. This is achieved by a central spring 35 positioned in space 34 to force plate 32 down evenly toward one upper surface of lower arm 36. A rectangular pin 33 is attached rigidly to plate 32 and passes through a rectangular hole in upper arm 31 larger than the pin to allow it to smoothly slide in and out of it. The rectangular shape maintains plate 32 from turning or twisting around the axis of pin 33, thus allowing it to remain aligned with the surface of lower arm 36 as plate 32 moves.

Alternatively, rather than a rectangular pin, a cylindrical pin could be used. This requires, however, a second cylindrical pin to be attached to plate 32 at a position remote from the location of the first pin. This pin would be rigidly attached to 32 and pass through a hole in upper arm 31. The hole would have a diameter slightly larger than the diameter of the pin, promoting smooth sliding of it through upper arm 31. This prevents plate 32 from twisting or turning.

Figure 4B:
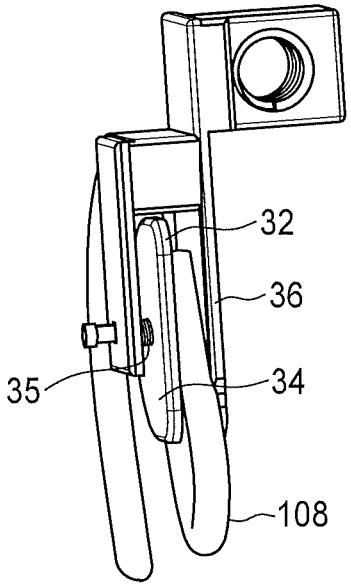
FIG. 4B is a perspective view of FIG. 4A with a boat hook present.

Referring still to FIG. 4, the upper surface of the spring 35 in space 34 works against the upper arm 31 which is held an appropriate distance from lower arm 36 by a block of material 30, allowing region 110 of a hook to be compressed by spring 35, generating enough force to hold the hook securely during the maneuvering of the pole, clamp, and hook to place it on a cleat. This clamping action and spring 35 in space 34 on a hook is illustrated in FIG. 4B. Referring still to FIG. 4A, lower arm 36 connects through the block or material 29 to housing 29 which connects to a threaded pole (not shown).

Figure 5A:
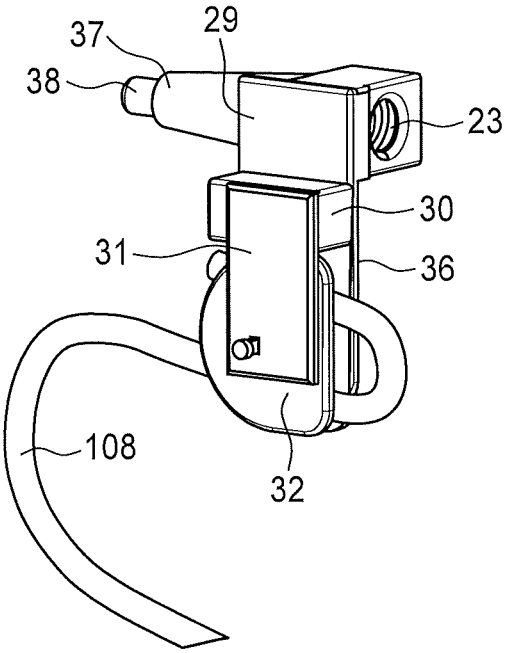
FIG. 5A is another perspective view of the variation of FIGS. 4A and 4B with a boat hook in a first position.
Figure 5B:
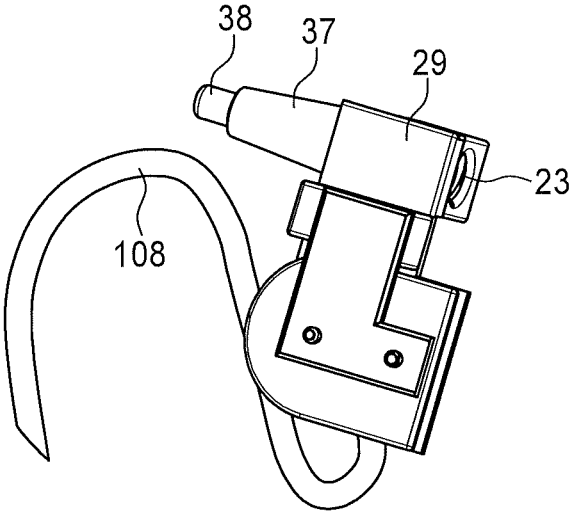
FIG. 5B is a perspective view similar to FIG. 5A with a boat hook in a second position.

FIG. 5A illustrates the embodiment of FIGS. 4A and 4B, showing projections 37 and 38 from housing 29. Projection 37 provides a support to mount a rubber or plastic cap 38 which when mounted on a pole can also be used to push a boat away from another boat, piling or other obstruction. FIGS. 5A and 5B illustrate how a hook 108 can be held in various positions with respect to the axis of a pole attached to the clamp to provide a favorable angle for hooking a cleat.

FIG. 5A shows a position for when the boat is a long way from the dock, similarly to FIG. 3A. FIG. 5B shows an angle which is advantageous when the boat is close to the dock and the operator is at an elevated position with respect to the dock, similar to FIG. 3B. The hook 108 can also be easily rotated to different angles as the situation requires. The mating surfaces of plate 32 and lower arm 36 can be coated with a rubber or other slip resistant material to prevent the hook sliding or slipping. Spring 35 tension is designed to hold the hook securely during maneuvering but to allow it to be pulled free easily once hooked. One spring tension design allows the compressed spring to produce adequate force on the hook to hold it during maneuvering but will allow the pole to pull loose once hooked. Another design provides a spring tension that allows the clamp to be opened fairly easily to place a hook in it for docking, although an optimized spring tension is required.

Figure 6A:
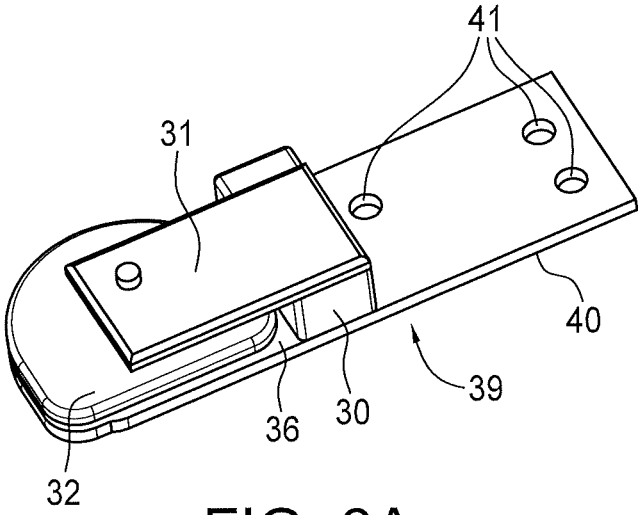
FIG. 6A is a perspective view of a second variation of the first type of boat hook assembly.
Figure 6B:
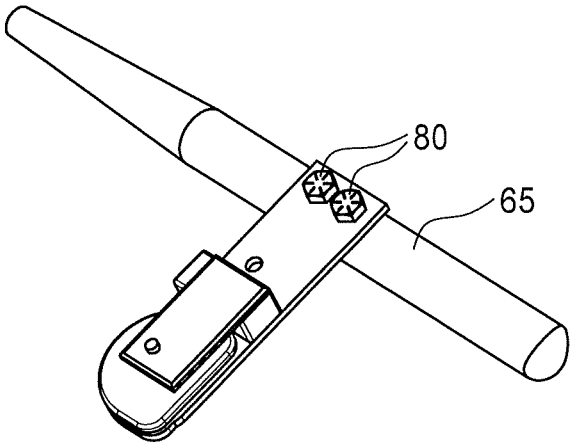
FIG. 6B is a perspective view of the second variation showing the clamp attached to a pole.
Figure 6C:
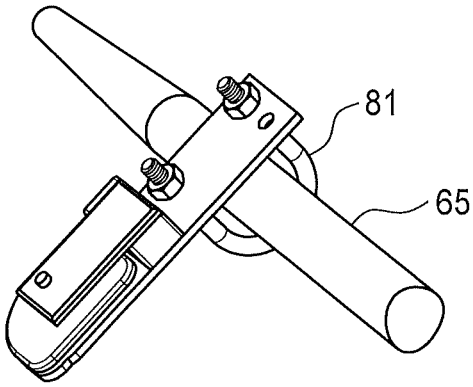
FIG. 6C is a perspective view showing an alternative attachment to the pole of FIG. 6B.

FIGS. 6A-6C show an embodiment of a clamp 39 which mounts to a pole with alternate arrangements. The basic hook clamping mechanism is the same as shown in FIGS. 4-5. FIGS. 6A-6C show an extension beam 40. Beam 40 extends from lower arm 36 all the way to the end of the clamp as a flat beam. The upper arm 31 stands off from beam 40 by the block of material 30. Three or more holes are formed in beam 40 to allow it to be bolted or riveted to a pole as in FIG. 6A or mounted with a U-bolt as in FIG. 6C. Mating holes must be first drilled in the pole 65 to accept bolts passed through holes 41 in beam 40. The bolts could be self-tapping screws or standard threaded bolts secured with nuts. Alternatively, two of the holes can be used to receive bolts of two U brackets 81. These U brackets would be placed around the pole 65 and when the bolts are tightened secure it to the pole, as shown in FIG. 6C.

Figure 7A:
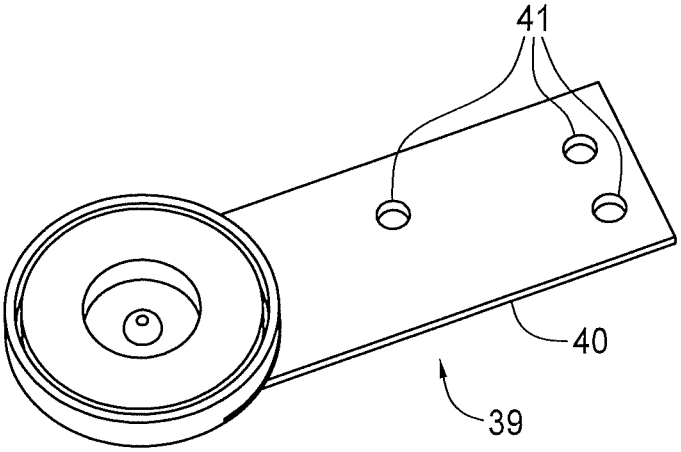
FIG. 7A is a perspective view of a portion a second embodiment of the present invention.
Figure 7B:
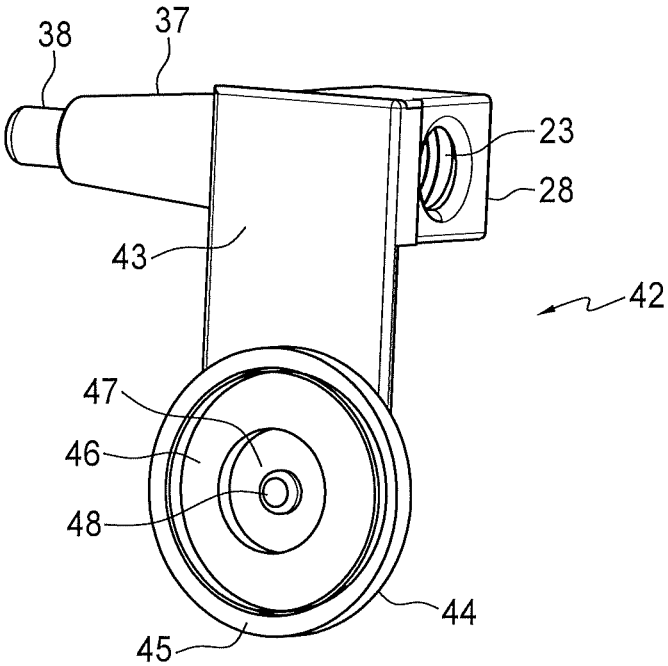
FIG. 7B is a perspective view of the second embodiment.

FIGS. 7A and 7 B show one magnet embodiment of the first type of boat hook assembly. FIG. 7A shows an embodiment 39 similar to FIG. 6A but uses a magnet to clamp the hook 108 or 109. FIG. 7B shows an embodiment 42 using a pole, similar to the threaded attachments method of FIGS. 4 and 5. Beam 43 in FIG. 7B extends away from housing 28 at a perpendicular angle and a length adequate for mounting the cylinder shaped magnet assembly 44. Magnet assembly 44 comprises an outer ferrite rim 45 on which is positioned on a flat round ferrite backing plate 47. A doughnut-shaped magnetized material element 46 is mounted securely on backing plate 47. A hole in the center of the backing plate 47 is used with a bolt or rivet 48 to mount the magnet assembly 44 onto beam 43. The design of the ferrite rim, backing plate and the magnet material element provide a magnetic pathway. If any ferrite material, such as a hook, encounters or is positioned across rim 45, the magnetic material element 46 is a strong holding force for the hook. The circular arrangement of the magnetic assembly allows a hook to be placed and easily rotated without coming loose.

Figure 8A:
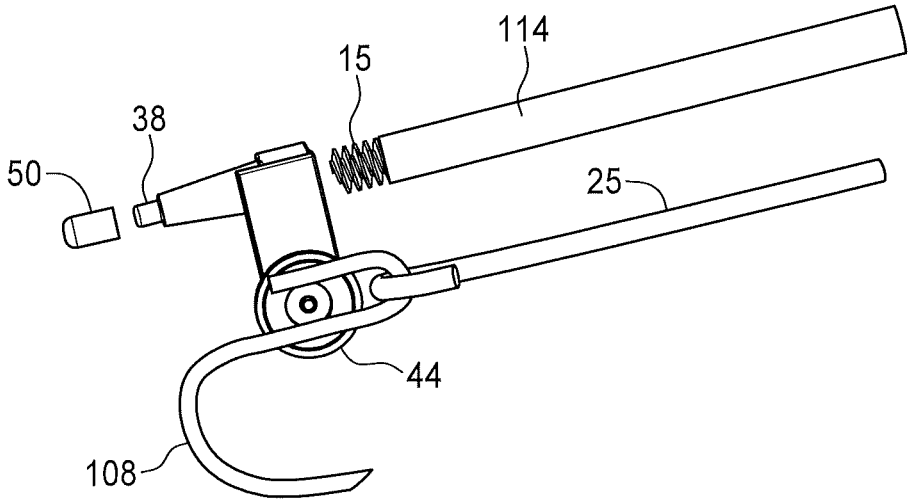
FIG. 8A is a perspective view showing the second embodiment with a boat hook element in place in a first position.
Figure 8B:
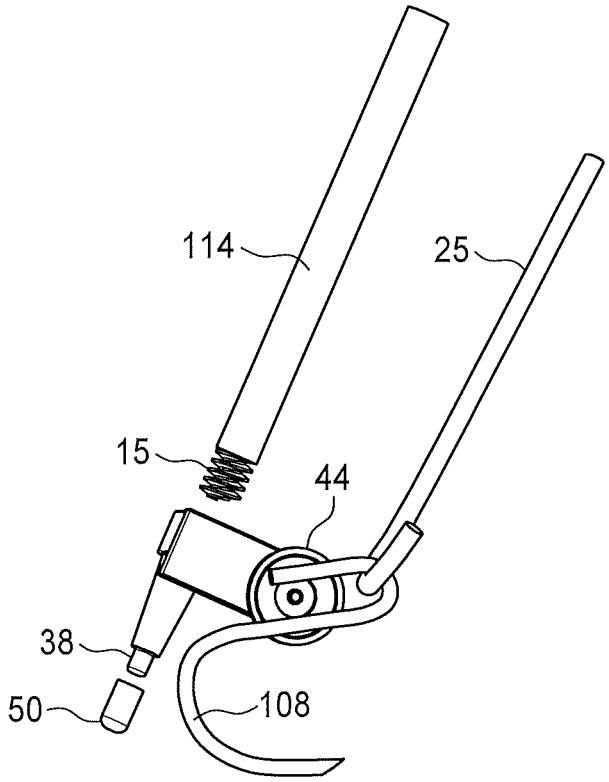
FIG. 8B is a perspective view of the second embodiment with a boat hook in a second position.

FIG. 8A shows the magnetic clamp embodiment being used with a hook 108 placed on it in a desirable angle for hooking a cleat when the boat is far away from the dock similar to that shown in FIGS. 3A and 5A. FIG. 8A also shows a pole 114 with threads 15 in position to engage the clamp. FIG. 8A also shows a small tip 38 adjacent to a rubber or plastic cap 50, in position to be applied to tip 38. The cap can be secured with adhesive to tip 38. Although the tip 38 is shown smooth it can be made with ribs around it or have threads to provide for holding the cap in place, with or without adhesive. FIG. 8B show a hook 108 or 109 clamped at an angle with respect to the axis of pole 14 which is advantageous for engaging hole 105 of a cleat 104 when the boat is close to the dock and the operator is at an elevated position to the dock. This angle is similar to that shown in FIGS. 3B and 5B. The advantage of the magnetic clamp embodiment is the hook can be easily rotated to any angle, including and between the angles shown in FIGS. 8A and 8B. Thus, the hook can be easily set to accommodate various distances and elevations between the operator and the dock. Another advantage is the hook can be quickly and easily attached and removed from the clamp. This is an advantage for operators who are not well trained in its use or lack sufficient strength or dexterity. The only disadvantage is the hook must be ferrite material. This would exclude stainless steel hooks which have lost their magnetic response due to their manufacturing process.

Figure 9A:
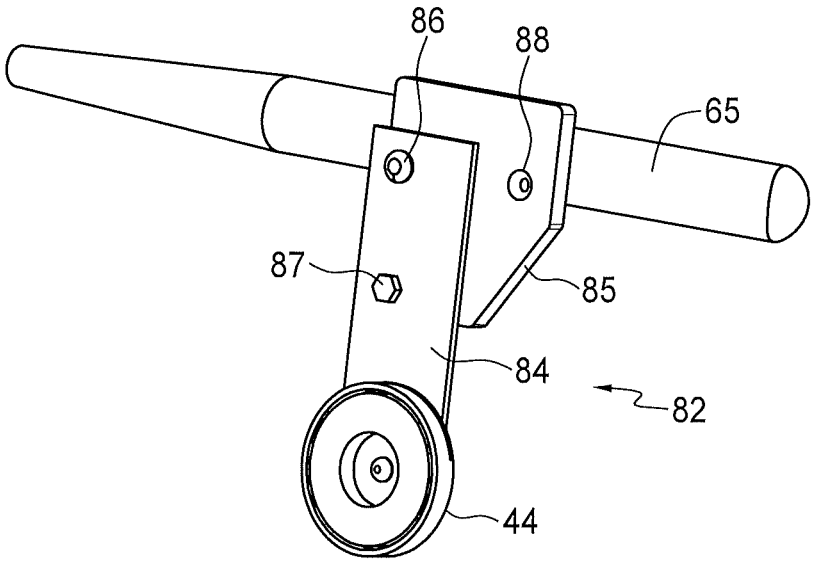
FIG. 9A is a perspective view of a variation of the second embodiment in an operative position.
Figure 9B:
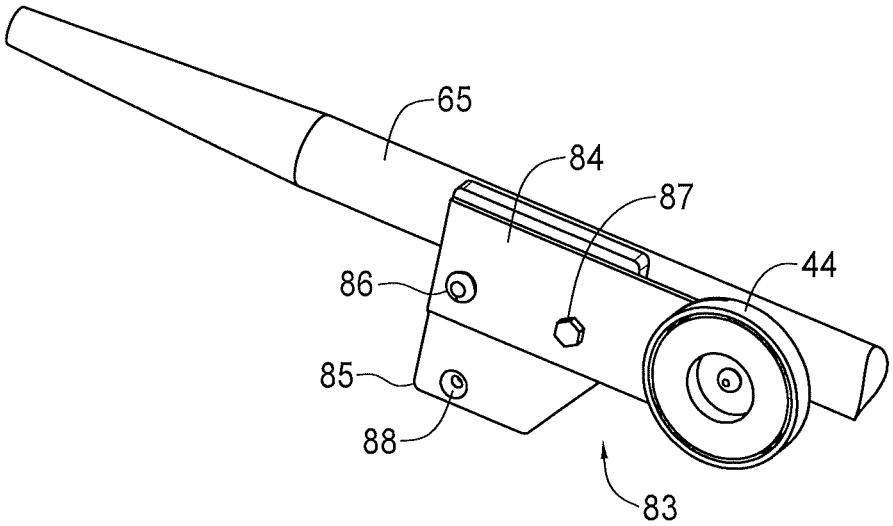
FIG. 9B is a perspective view of the variation of FIG. 9A in a stowed position.
Figure 10:
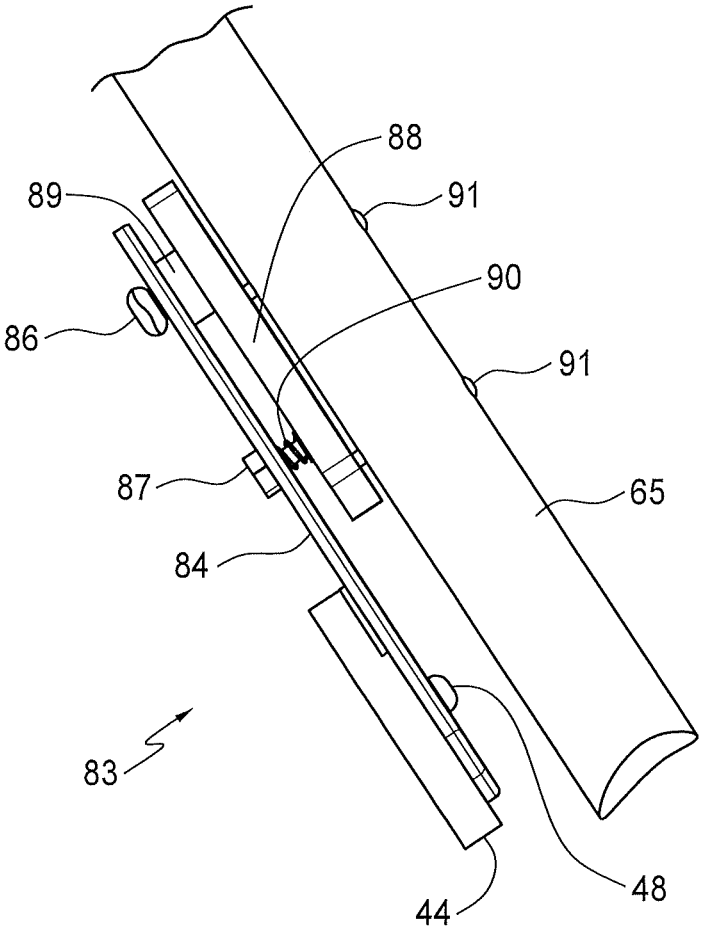
FIG. 10 is a side view of the embodiment of FIG. 9B.

FIGS. 9 and 10 illustrate an embodiment in which the magnetic clamp assembly 44 can be rotated into the position in FIG. 9A for clamping the hook and then rotated or swiveled to a second position shown in FIG. 9B for storage. The details of the swiveling mechanism are shown in FIGS. 9A and 9B and in FIG. 10. Referring to FIG. 9A, a base plate 85 is mounted on to a pole 65 by two bolts 91 (FIG. 10). Arm 84, which holds magnetic assembly 44, is attached to the base plate 85 by a pivot element 86 using a low friction spacer 89 to hold them apart. Base plate 85 has two detent depressions 88 to hold arm 84 in the two position shown in FIGS. 9A and 9B by a detent pin 87 with a spring 90 to force the pin 87 into the detent depressions 88 thus holding arm 84 in either of the two positions of FIG. 9A or 9B.

Figure 11A:
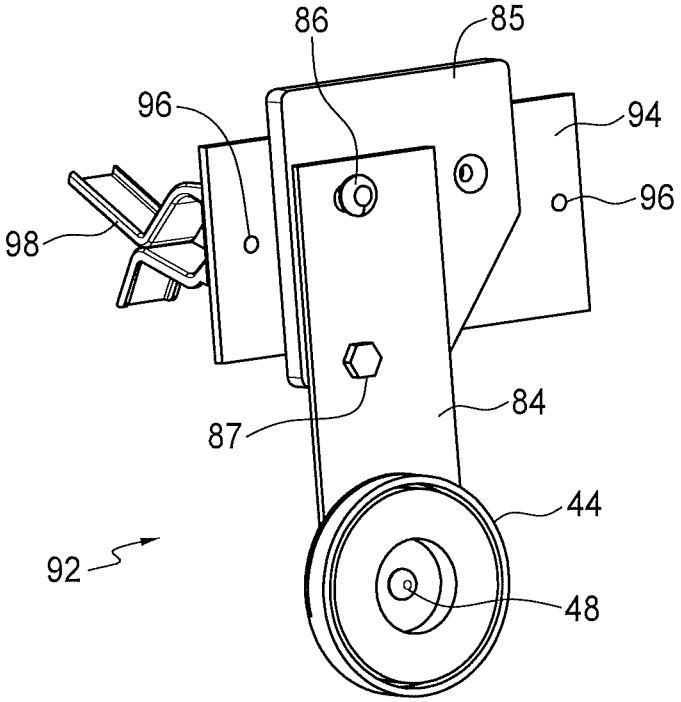
FIG. 11A is a front perspective view of a variation of the embodiment of FIGS. 7-10.
Figure 11B:
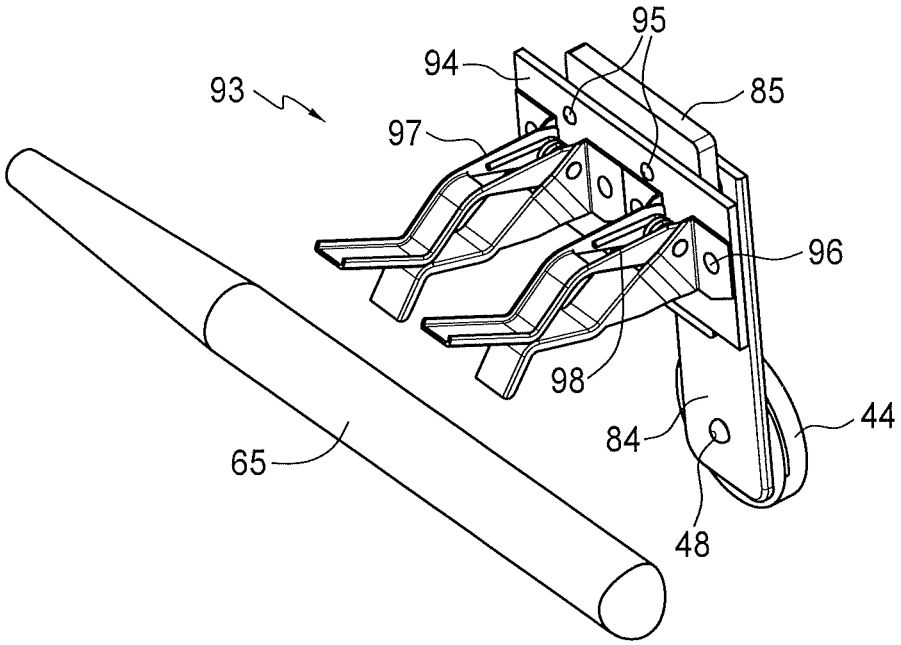
FIG. 11B is a rear perspective view of the embodiment of FIG. 11A.

FIG. 11 shows an alternative embodiment for holding a magnetic clamp 44 or alternatively a mechanical clamp such as shown in FIG. 6A by means of clips to a pole 65. This allows applying or removing the clamp easily from the pole. For illustration, a swivel magnetic clamp such as shown in FIGS. 9 and 10 is shown. Two bolts 95 attach a mounting plate 94 to base plate 85. Two broom type clips 97 and 98 are mounted to mounting plate 94 using screws 96. The broom clips 97 and 98 snap on and off a pole 65 as required.

Figure 12A:
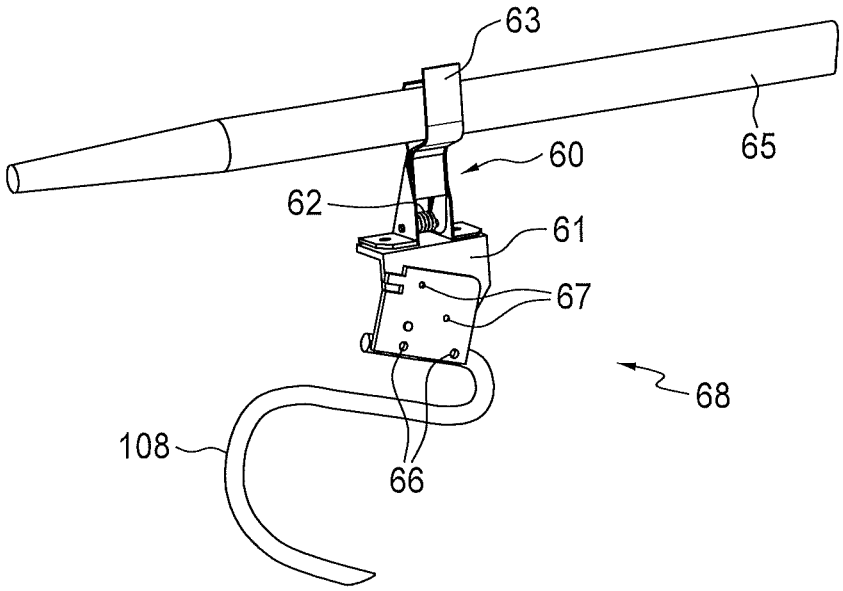
FIG. 12A is a perspective view of another embodiment of the present invention showing a clamp portion in a first position.
Figure 12B:
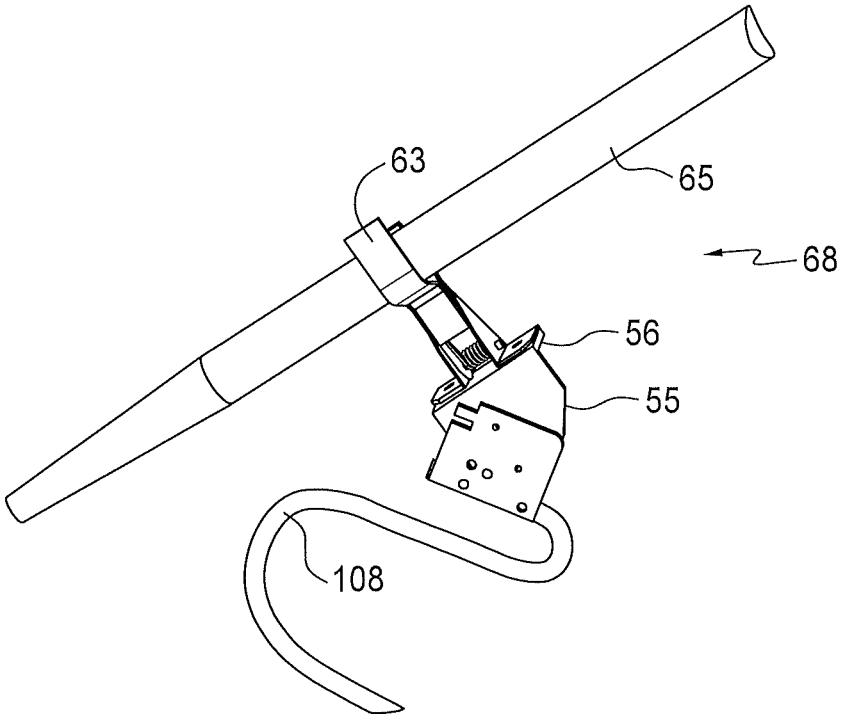
FIG. 12B is a perspective view of the embodiment of FIG. 12A showing the clamp in a second position.

FIGS. 12A and 12B show a second type of dock hook arrangement. In this arrangement, a clip is fixed to a clamp to which a hook is fixedly attached. A commercially available clip that is commonly mounted on a wall and used to clamp and hold a broom handle or other tool to the wall can be used. The clamp has a hinge mechanism and a spring 62 to hold two clamping arms or fingers 63 and 64 in FIGS. 13A-13C together or onto a member inserted between them, such as a pole 65. The pole can be of a telescoping or a fixed length type.

Figure 13A:
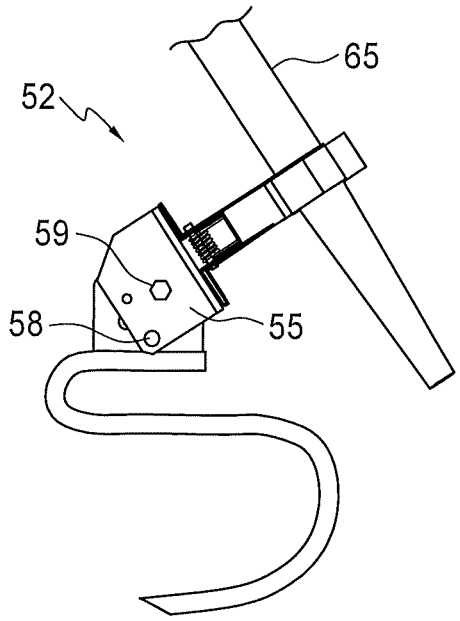
FIG. 13A is a perspective view of the embodiment of FIG. 12A showing the clamp in another position.
Figure 13B:
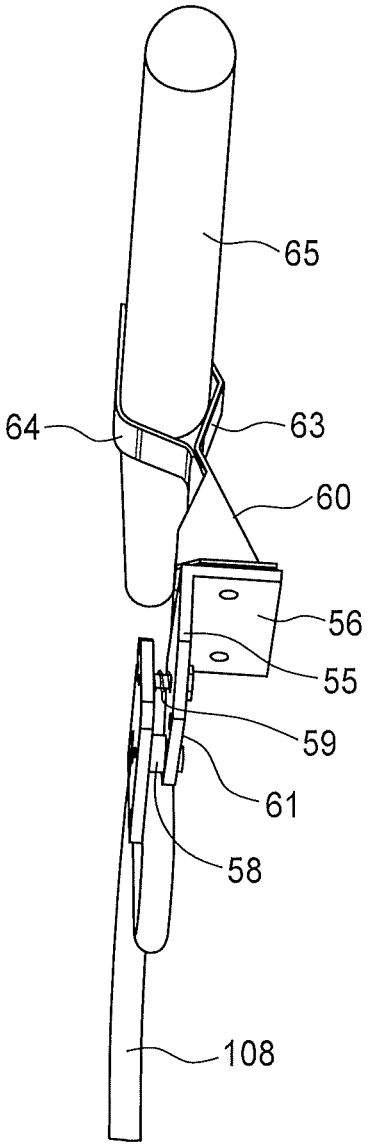
FIG. 13B is a side perspective view of the embodiment of FIG. 12A.
Figure 13C:
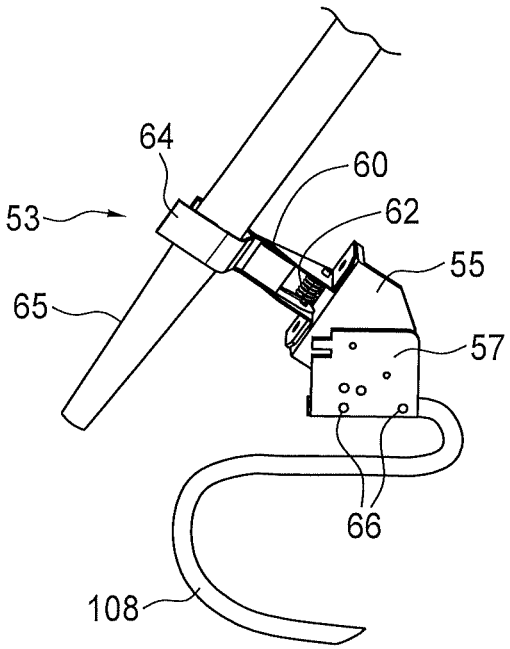
FIG. 13C is a rear perspective view of the embodiment of FIG. 12A.

FIGS. 13A-13C show further views of clamp assembly 68 to which a hook 108 or 109 is rigidly attached. FIGS. 13A and 13C are opposing side views and FIG. 13B is an end view. Clamp 60 is secured to a first flat portion 56 of an angle bracket 55 by screws or rivets or other bonding means. The angle bracket 55, typically 90°, includes a second flat portion 61 which mates with plate 57 to together hold hook 108 or 109 by mating holes 66 and are secured together with bolts or rivets. A pivot assembly 58 comprises a rivet or bolt and nylon spacer washers between 55 and 57 to provide proper spacing and to allow plate 57 to rotate with respect to second flat plate 61. A spring-loaded detent 59 is secured to bracket 55. Two or more holes 67 are present in the flat plate 57 which are counter sunk from the side of the flat plate facing the angle bracket 55. These counter sunk holes provide a seat for the spring-loaded detent 59 when the bracket 55 is rotated appropriately with respect to the flat plate 57. The combination of the tension of the spring in the detent 59 and the small depth of the counter sunk 67 holes provide enough resistance to hold and prevent bracket 55 from rotating with respect to the plate 57 during normal cleat hooking maneuvers. However, the holding strength is not great enough to prevent an operator from rotating the bracket 55 with respect to the plate 57 with their hands when they are setting up to perform a docking procedure. Therefore, the angle of the hook with respect to the axis of the pole 65 can be selected as illustrated in FIG. 9A or 9B to accommodate the situation where the boat is far from the dock or close to the dock with the operator in an elevated position with respect to the dock.

Figure 14A:
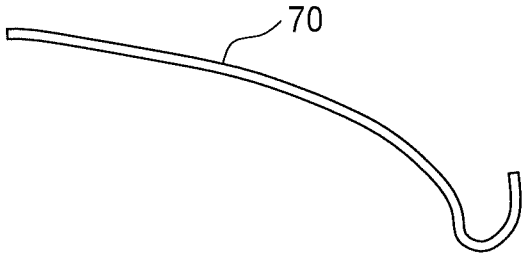
FIG. 14A is an edge view of an attachment element for use with the embodiments of FIGS. 2-6.
Figure 14B:
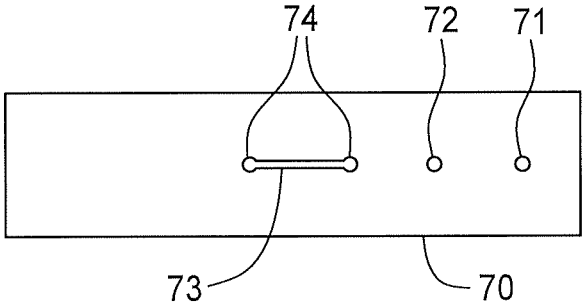
FIG. 14B is a perspective view of the element of FIG. 14A
Figure 14C:
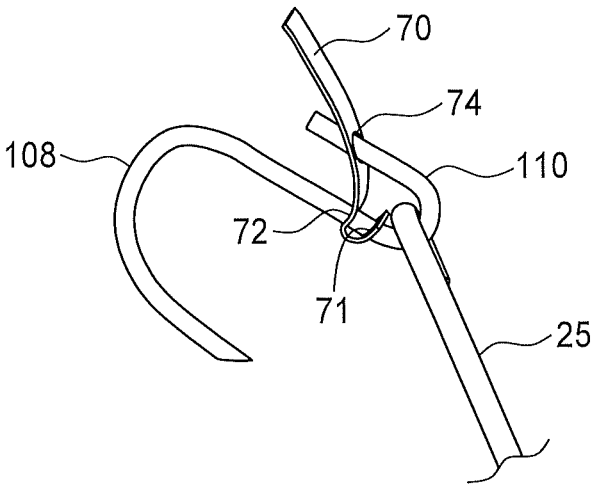
FIG. 14C is a perspective view showing the attachment element of FIG. 14A in place on a boat hook.

FIGS. 14A and 14B illustrate a means for ensuring rope 25 remains secured to the rope attachment end 110 during hooking a boat securing assembly. In FIGS. 14A and 14B, a flat piece of rubber or leather 70 is shown. A rubber material with a thickness of 1/16" has been found to work successfully. Holes 71 and 72 are punched which will allow the round hook body to slip through it but fit snuggly. Further, smaller holes 74 are punched spaced about 1 inch apart as shown. A narrow slot 73 is cut between the two smaller holes 74. FIG. 14C shows an edge on view of element 70 with it bent in the desired shape when applied to hook 108. FIG. 14B shows a hook 108, or 109, with the rope 25 passed over the hook in region 110. The region 110 of the hook 108 has been moved through holes 71 and 72 of element 70. This section can remain attached to the hook when not in use so as to be ready to use when docking is planned. Once rope 25 is positioned, it can be pulled and passed over the end of the hook region 110 of the hook through the holes 74 and slot 73 as shown. Element 70 then should act as a strap to hold the rope in place from falling out of the region 110 of the hook 108. Once the hook has properly engaged with a cleat or 4"×4" railing and the operator desires to remove the rope they then tug on the end of 70 and pull that region of it off the 110 end of the hook. The rope then can be removed to continue the securing of the boat. Alternatively, but not shown, a wire type of spring could be used which opens to position and remove a rope. When closed the spring ensures that the rope remains attached during placement.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A deployable boat hook assembly for securing a boat to a dock, comprising:

a mechanical clamping assembly, attachable to a pole, wherein the clamping assembly includes a clamp adapted to temporarily secure a boat hook which is configured to connect to a receiving member on a dock, the boat hook further configured to receive a boat line extending from the boat, wherein the temporary securement of the boat hook is overcome by an operator moving the pole in a manner to release the clamping assembly from the pole, such that the boat is connected to the dock by the boat hook and the boat line;

wherein the clamping assembly includes a lower arm member, an upper arm member and an intermediate plate, and further includes a spring forcing the intermediate plate in the direction of the lower arm member to hold the boat hook in place therebetween.

2. The boat hook assembly of claim 1, wherein the pole is threadably engagable with the clamping assembly.

3. The boat hook assembly of claim 1, wherein the clamping assembly includes slip resistant material to increase securement of the clamping assembly.

4. The boat hook assembly of claim 1, including a strap element which is configured to be connectable to the boat hook in a manner to prevent the boat line from slipping off the boat hook when the boat line is present on the boat hook.

5. The boat hook assembly of claim 1, including a rectangular pin attached to the intermediate plate and passing through a rectangular opening in the upper arm member, allowing the intermediate plate to remain aligned with the lower arm member as the intermediate plate moves toward the lower arm under action of the spring.

6. The boat hook assembly of claim 1, including two spaced pins attached to the intermediate plate passing through openings in the upper arm member, allowing the intermediate plate to remain aligned with the lower arm as the intermediate plate moves toward the lower arm member under action of the spring.

7. The boat hook assembly of claim 1, wherein the lower arm is fixably attached to the pole.

8. The boat hook assembly of claim 7, wherein the lower arm is fixably attached to the pole by one or more U-clamps.

9. A deployable boat hook assembly for securing a boat to a dock, comprising:

a magnetic clamping assembly attachable to a pole, wherein the clamping assembly includes a clamp adapted to temporarily secure a boat hook which is configured to connect to a receiving member on a dock, the boat hook further configured to receive a boat line extending from the boat, when the temporary securement of the boat hook is overcome by an operator moving the pole in a manner to release the boat hook from the clamping assembly, such that the boat is connected to the dock by the boat hook and the boat line, wherein the magnetic clamping assembly is mounted on a beam plate, wherein the magnetic clamping assembly includes a magnetized element which is positioned for direct contact with the boat hook, wherein when the boat hook is positioned on the magnetic clamping assembly, the magnetic attraction between the magnetic clamping assembly and the boat hook is sufficient to hold the boat hook to the magnetic clamping assembly as the boat hook is connected to the receiving member on the dock.

10. The boat hook assembly of claim 9, wherein the pole is attached to the magnetic clamping assembly by a threadable attachment assembly.

11. The boat hook assembly of claim 10, wherein the threadable attachment assembly includes a housing and wherein the beam plate extends from the housing.

12. The boat hook assembly of claim 11, wherein the magnetic clamping assembly includes a magnetic member with a rim and further includes the magnetized element secured to the magnetic member, wherein the magnetic member is mounted to the beam plate, wherein in operation, a portion of the boat hook is positioned in direct contact with the magnetic member rim and the magnetized element, wherein magnetic attraction is sufficient to hold the boat hook to the magnetic assembly and wherein the boat hook can be positioned at selected locations on the magnetic rim.

13. The boat hook assembly of claim 11, including a flexible member which extends from the housing and a cap connected to the flexible member.

14. The boat hook assembly of claim 9, including a connecting plate attached to the pole, and wherein the beam plate is pivotably attached to the connecting plate, the magnetic assembly further including a spacer between the connecting plate and the beam plate and two detent arrangements, permitting the beam plate to be swiveled 90° about a pivot member.

15. The boat hook assembly of claim 9, wherein the magnetic assembly includes a support assembly connected to the beam plate, and two spaced clamping members on the support assembly for releasably connecting the magnetic assembly to the pole.

16. A deployable boat hook assembly for securing a boat to a dock, comprising:

a clamping assembly which includes a securing portion permitting the clamping assembly to be removeably attachable to a pole;

a boat hook configured to receive a boat line extending from the boat, wherein the clamping assembly further includes a first attachment portion to which the boat hook is non-releasably attached, and a second attachment portion connected to the securing portion and the first attachment portion.

17. The boat hook assembly of claim 16, wherein the second attachment portion is an L-shaped member, a first section of which is attached to the securing portion of the clamping assembly, which securing portion is a spring clip assembly, and a second section of which is pivotally connected to the first attachment portion.

* * * * *